US010433643B2

(12) United States Patent
Djankovich et al.

(10) Patent No.: US 10,433,643 B2
(45) Date of Patent: Oct. 8, 2019

(54) PORTABLE REBOUNDING DEVICE

(71) Applicant: Rocking Inc., Irvine, CA (US)

(72) Inventors: Mladen Djankovich, Irvine, CA (US); Milena Djankovich, Irvine, CA (US)

(73) Assignee: Rocking Inc., Irvine, CA (US)

( * ) Notice: Subject to any disclaimer, the term of this patent is extended or adjusted under 35 U.S.C. 154(b) by 49 days.

(21) Appl. No.: 15/978,000

(22) Filed: May 11, 2018

(65) Prior Publication Data

US 2018/0332968 A1 Nov. 22, 2018

Related U.S. Application Data

(60) Provisional application No. 62/645,901, filed on Mar. 21, 2018, provisional application No. 62/505,834, filed on May 12, 2017.

(51) Int. Cl.
*A47C 3/02* (2006.01)
*A47C 7/42* (2006.01)

(52) U.S. Cl.
CPC ..... *A47C 3/02* (2013.01); *A47C 7/425* (2013.01)

(58) Field of Classification Search
CPC .. A47C 4/286; A47C 7/70; A47C 7/72; A47C 4/02; A47C 7/40; A47C 7/44; A47C 7/462; A47C 1/023; A47C 1/03255; A47C 31/126; A47C 7/004; A47C 1/146; A47C 7/425; A47C 7/4454; A47C 7/445; A47C 3/023; A47C 3/021; A61G 2200/34; A61H 2201/1633; B60N 2/20; B60N 2/22
USPC ..... 297/133, 230.1, 352, 295
See application file for complete search history.

(56) References Cited

U.S. PATENT DOCUMENTS 1,587,749 A * 6/1926 Bierly ..... A63B 25/10 482/80
2,025,621 A * 12/1935 Soule ..... A47C 3/023 297/295
2,384,234 A * 9/1945 Breese ..... A47B 85/04 297/2
2,914,116 A * 11/1959 Gohmann ..... A47C 16/02 108/1
3,036,389 A * 5/1962 Wesch ..... A43B 5/18 36/7.8
3,120,008 A * 2/1964 Watson ..... A47C 20/027 5/634
3,195,954 A * 7/1965 Moreno ..... A47C 4/02 297/440.11
4,064,580 A * 12/1977 Ezekoye ..... A47C 16/005 5/652
4,208,070 A * 6/1980 Geschwender ..... A47C 3/04 297/118
4,360,978 A * 11/1982 Simpkins ..... A43B 5/18 36/114
4,410,214 A * 10/1983 Geschwender ..... A47C 3/04 297/118

(Continued)

OTHER PUBLICATIONS

International Search Report and Written Opinion of the International Searching Authority prepared by the USPTO in connection with PCT/US2018/32453, dated Oct. 15, 2018; Entire Document (12 pages).

*Primary Examiner* — Shin H Kim
(74) *Attorney, Agent, or Firm* — Richards Patent Law P.C.

(57) ABSTRACT

A rebounding device includes a front member, a rear member, and a spring mechanism positioned between the front member and the rear member for allowing the front member and rear member to move toward and away from one another.

18 Claims, 19 Drawing Sheets

(56) References Cited

U.S. PATENT DOCUMENTS 4,908,891 A * 3/1990 Blagg ..... A47C 1/146 297/352
5,195,258 A * 3/1993 Loader ..... A43B 21/30 36/34 R
5,203,611 A * 4/1993 Greenwood ..... A47D 13/107 297/275
5,352,173 A * 10/1994 McLaughlin .... A63B 23/03575 482/121
5,425,567 A * 6/1995 Albecker, III ..... A47C 1/146 297/377
6,132,338 A * 10/2000 Shifferaw ..... A63B 5/08 482/30
6,155,647 A * 12/2000 Albecker, III ..... A47C 1/146 297/228.12
6,716,144 B1 * 4/2004 Shifferaw ..... A63B 21/023 297/161
7,175,567 B2 * 2/2007 Barbafieri ..... A63B 5/08 482/30
8,715,141 B2 * 5/2014 Bes ..... A63B 5/11 482/52
10,179,261 B2 * 1/2019 Licklider ..... A63B 5/08
2004/0164219 A1 * 8/2004 Rivera ..... A47C 3/021 248/628
2004/0183348 A1 * 9/2004 Kniese ..... A47C 7/405 297/284.1
2005/0280298 A1 * 12/2005 Hsiao ..... A47C 7/40 297/284.4
2006/0279122 A1 * 12/2006 Huffman ..... A47C 7/383 297/397
2010/0117419 A1 * 5/2010 Schmitz ..... A47C 1/03255 297/284.1
2012/0304392 A1 * 12/2012 Khambete ..... A47C 27/001 5/717
2013/0169017 A1 * 7/2013 Masunaga ..... A47C 1/03255 297/320
2013/0345028 A1 * 12/2013 Bes ..... A63B 5/11 482/79
2016/0007671 A1 * 1/2016 Prust ..... A47C 27/144 2/411
2017/0231396 A1 * 8/2017 Beyer ..... B68G 5/00 297/284.7
2018/0332968 A1 * 11/2018 Djankovich ..... A47C 3/02

* cited by examiner

PORTABLE REBOUNDING DEVICE

CROSS-REFERENCE TO RELATED APPLICATIONS

This application incorporates by reference and claims the benefit of priority to U.S. Provisional Application 62/505,834 filed on May 12, 2017 and U.S. Provisional Application 62/645,901 filed on Mar. 21, 2018.

BACKGROUND OF THE INVENTION

The present subject matter relates generally to a portable rebounding apparatus. More specifically, the present invention relates to a rebounding device to be used against a stationary surface for generating a rebounding motion.

Rocking is a familiar part of everyday human life. Numerous proven benefits of rocking have been established for centuries, while new motivations and added reasons for rocking are being discovered regularly. One of the most well-known uses for rocking is to calm a baby. The gentle bouncing motion mimics the movement the baby felt inside the mother's womb and can soothe infants, aid in lulling children to sleep or while nursing, and reduce crying in colic episodes.

Rocking for personal benefit is a safe activity and option for those that live an otherwise sedentary lifestyle or for people with limited physical motion, including many aging adults, individuals suffering with injuries or chronic ailments, or those seated for long periods of time in a chair or at a desk. The act of rocking has proven benefits such as the easing of arthritis and back pain, improved muscle tone, improved balance, and increased circulation.

Studies have revealed that rocking causes an increase in psychological well-being for those suffering from dementia, anxiety, and depression due to released endorphins that elevate the mood. Additional studies suggest benefits of rocking can provide comfort and add to the positive treatment of anxiety, attention deficit disorder, attention deficit hyperactivity disorder, and autism. NASA has reported that rocking was the most effective procedure to combat Autonomic Nervous System Disorders for astronauts returning to earth from low-earth orbit. Rocking may also be a low-energy movement to increase blood flow for those experiencing physical restrictions, such as elderly and handicapped people. Health experts recommend some form of motion to increase circulation and muscle movement when sitting for long periods in office chairs.

However, prolonged rocking in a seated position cannot be performed comfortably without an external device such as a rocking chair to assist in repeating the motion for even a short period of time, let alone hours on end. A continuous rocking motion for long durations without assistance also creates significant strain on muscles and joints. Existing solutions are extremely limited in their embodiments, versatility, and flexibility of use. The operating conditions and other utility requirements often prohibit users from being able to use existing apparatuses when and where rocking assistance is needed most. The use of conventional rocking furniture is limiting in that it cannot easily be moved from room to room or accompany the user during travel.

Further, conventional rocking solutions require a large amount of floor space and are therefore not suitable for use in small rooms and can be difficult to store when not in use. While some hospitals and nurseries equip parents, staff, and caregivers with rockers or gliders, providing a rocker or glider in each room is expensive, which becomes problematic for facilities operating with a limited budget. Smaller options for rocking infants include bassinets, bouncers, or cradles, but in these options the infant is separated from the caregiver, limiting the ability to simultaneously hold, nurse, or easily feed the infant while rocking.

Further, conventional rocking solutions cannot be combined with other existing furniture such as a sofa or bed, thus preventing users from utilizing such furniture when needing to hold and nurse or calm an infant with rocking. Many mothers prefer to nurse while sitting in an upright position in bed, especially at night, but must choose between the comfort of a bed and the functionality of a rocking device because nothing exists to allow both simultaneously.

Accordingly, there is a need for a portable, compressible rebounding device that may be used against a stationary surface for generating a rocking motion while in a seated position, as described herein.

BRIEF SUMMARY OF THE INVENTION

To meet the needs described above and others, the present disclosure provides a rebounding device that includes a spring mechanism between a front member and a rear member. During use, the user positions the rear member of the rebounding device against a stationary object such as a chair or a wall. The user rests his back against the front member and applies pressure to generate a gentle rocking motion. The rebounding device exerts a biasing force when compressed that gently propels the user's upper body forward while maintaining a seated position.

In one embodiment, the rebounding device includes a front member, a rear member, and a spring mechanism positioned between the front and rear members. The spring mechanism includes first and second elongate spring elements, each spring element including front and rear planar surfaces integral with a rounded portion. Each spring element operates as a leaf spring with the front and rear planar surfaces moving toward and away from one another about the rounded portion.

Each of the front planar surfaces of each spring element is twisted inwardly toward the rear planar surfaces so as create a curvature for receiving the user's back. The front member is secured to the front planar surfaces of the spring elements and includes a curvature that complements the curvature of the front planar surfaces. The rear member is secured to the rear planar surfaces of the spring element. During use, the user's back rests comfortably against the curved front member and the angled front planar surfaces while the rear member and the rear planar portions rest against the stationary surface.

In one embodiment, the front and rear members include a front and rear flexible material extending between the pairs of front and rear planar surfaces, respectively, of the first and second spring elements. The front and rear flexible materials are tightly stretched between the front and rear pairs of the front planar portions and the rear planar portions, respectively, of the first and second members so that pressure applied to the material causes the front planar portions to move toward the respective rear planar portions. A foam padding or other thick material may be secured to each of the front and rear members and/or flexible material.

In a further embodiment, a rebounding device includes a housing having front and rear members containing a spring mechanism. The housing is comprised of a foam material that allows for compression. During use, the user positions the rebounding device between his back, preferably the middle to lower portions of the back, and a supporting surface such as a headboard, an airplane seat, or a wall. The rebounding device exerts a biasing force when compressed that propels the user's upper body forward while maintaining a seated position.

Specifically, each of the front and rear members of the housing includes a planar surface surrounded by a wall that has a greater thickness at a base and narrows near the planar surface, creating an outer side surface. The bases of the front and rear members are adjoined together by fastening means. A spring mechanism positioned between the front and rear members includes spring elements that bias against the planar surfaces of the front and rear members. The spring mechanism may be any elastic object(s) storing mechanical energy that creates an opposing force when compressed, such as a plurality of helical springs. The internal distributed structuring of the springs provides an even spring sensation for the user without the need for a central spring. Other suitable spring mechanisms may be used.

The housing may be comprised of a compressible material such as a ventilated foam, which also allows for breathability and minimizes the weight of the device. The rebounding device may also include a cover or casing that surrounds the housing. Heating or cooling elements may be incorporated into the housing and/or the cover.

An object of the invention is to provide a solution to provide a smooth, repeatable bouncing motion, while also significantly reducing the strain on the body and diminishing the physical activity and force required to make the body rock.

Another object of the invention is to provide a solution to a convenient rebounding device that is positioned between the user's back and against any supporting surface.

A further advantage of the invention is that it is specifically contoured to the upper body to provide a comfortable and supporting rebounding motion against the user's lean.

An advantage of the invention is that it provides a portable rebounding device that is easily carried from one location to another, takes up little space, and can be easily stored away when not in use.

Another advantage of the invention is that it can be utilized with almost any existing furniture or supporting surface; thereby allowing the user to rock continuously while holding the infant while sitting wherever they have a supporting surface deemed comfortable.

A further advantage of the invention is that it provides a solution to a need for a rocking motion that is significantly less expensive than conventional rocking solutions.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
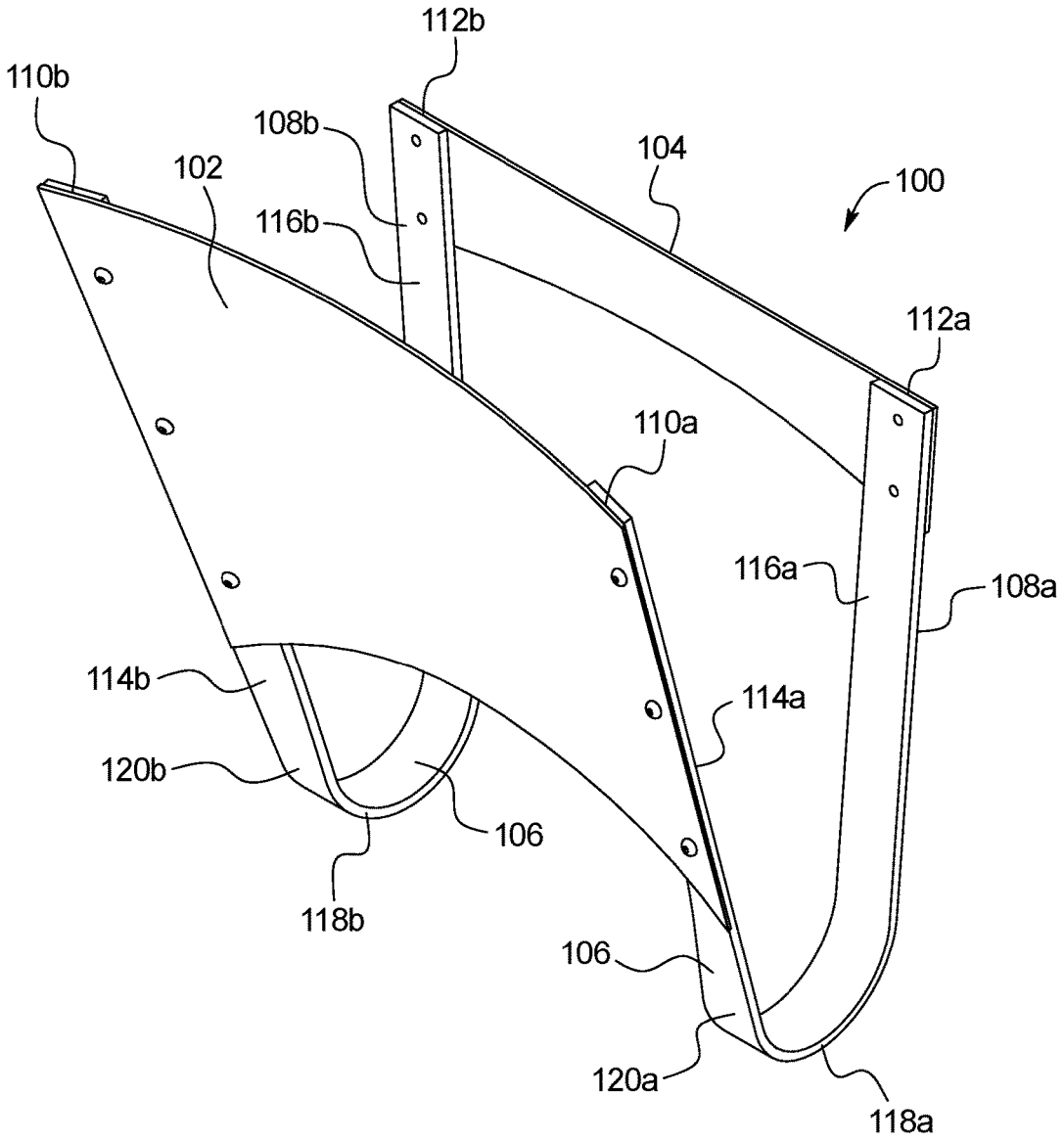
FIG. 1 is a front, perspective view of a rebounding device of the present application.

FIG. 1 illustrates an example of a rebounding device 100. As shown in FIG. 1, the rebounding device 100 includes a front member 102, a rear member 104, and a spring mechanism 106 positioned between the front and rear members 102, 104. During use, the rear member 104 rests against a solid surface as shown in FIGS. 15-19. The user positions his back against the front member 102 and applies pressure to create a gentle, rocking motion. During use, the user positions the rebounding device 100 between his back and a supporting surface such as the headboard of a bed, the back of a sofa, an airplane seat, or a wall. The rebounding device 100 exerts a biasing force when compressed that propels the user's upper body forward while maintaining a seated position. The combination of the biasing force of the rebounding device 100 against the weight of the user generates a momentum that allows continued bouncing while rocking an infant or oneself for personal relaxation, activity, or comfort, while requiring little effort for hours on end.

Figure 2A:
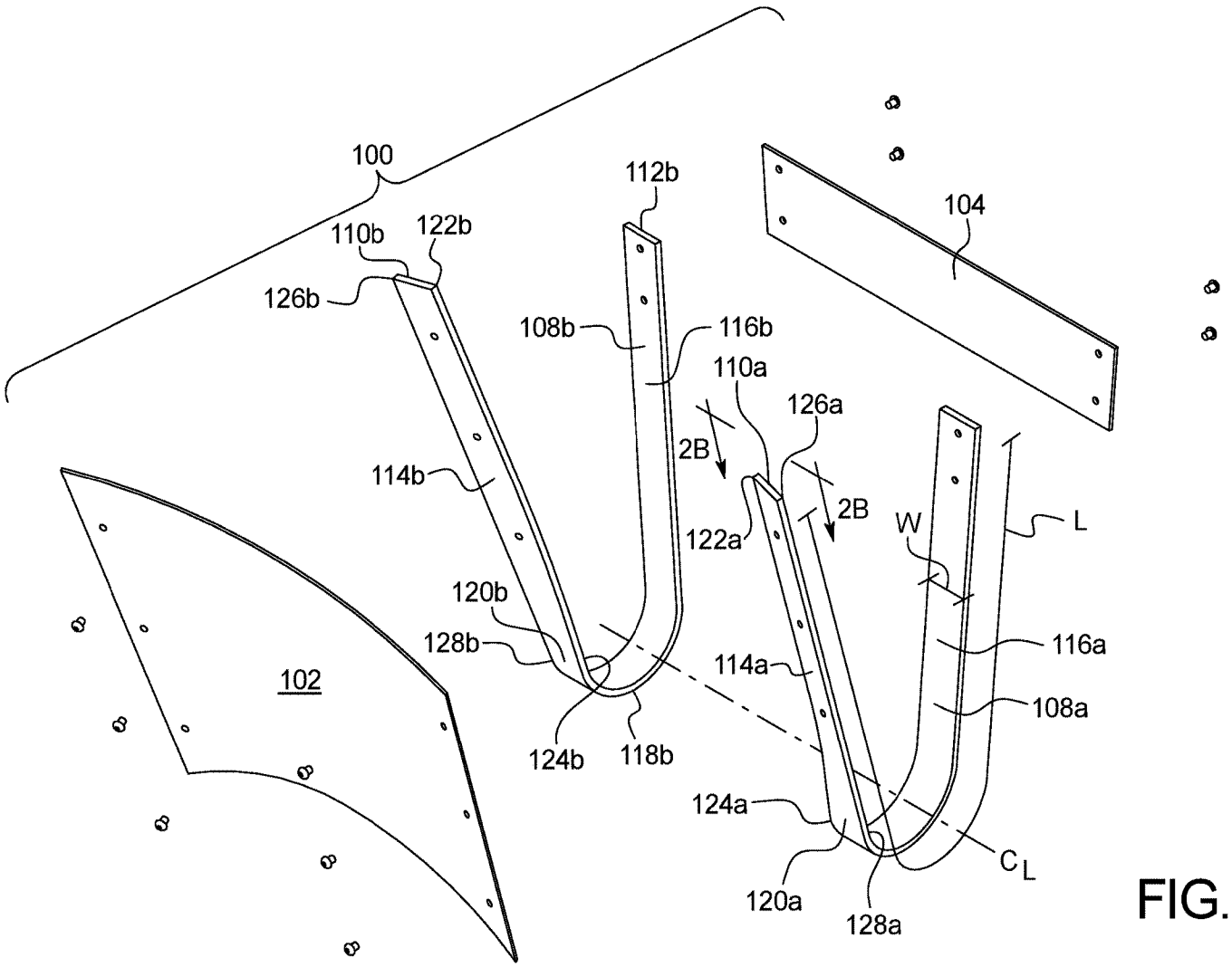
FIG. 2A is an exploded, perspective view of the rebounding device of FIG. 1.

In the illustrated embodiment, the spring mechanism 106 includes first and second spring elements 108*a*, 108*b*, each having an elongate shape including a length L and a width W, the length L being greater than the width W, and extending between a front end 110*a*, 110*b* and a rear end 112*a*, 112*b*. Each elongate spring element 108 curves around an axis $C_L$ as shown in FIG. 2A. The axis $C_L$ is parallel to the width W of the respective spring element 108 and is spaced apart from a midpoint along the length L, separating the length L of the spring element 108 into a front planar surface 114 and a rear planar surface 116 by a rounded portion 118. The front planar surfaces 114*a*, 114*b* and the rear planar surfaces 116*a*, 116*b* extend adjacent to but slightly angled away from each other when in a resting position. The rounded portion 118 functions as the spring leaf mechanism that enables the rebounding device 100 to provide a rebounding motion.

Figure 2B:
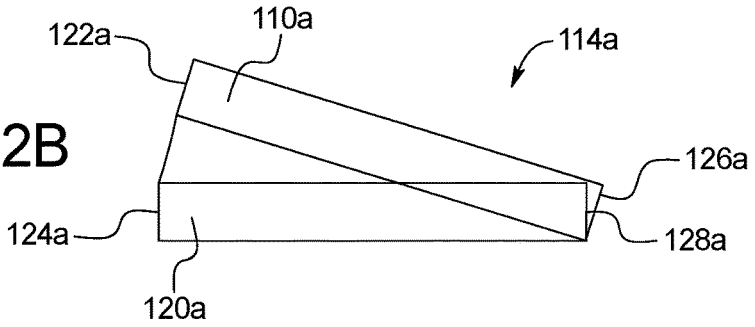
FIG. 2B is a top plan view of a front planar surface of a spring element of the rebounding device of FIG. 1, illustrating curvature.
Figure 3:
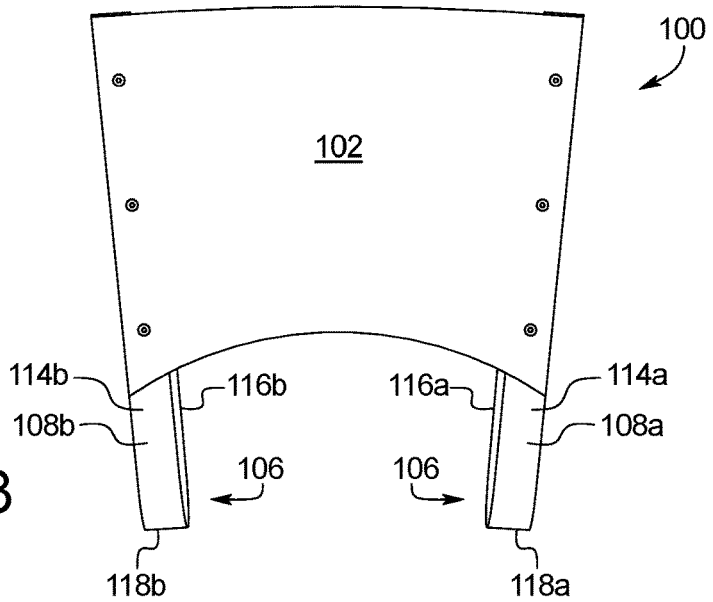
FIG. 3 is a front elevational view of the rebounding device of FIG. 1.
Figure 4:
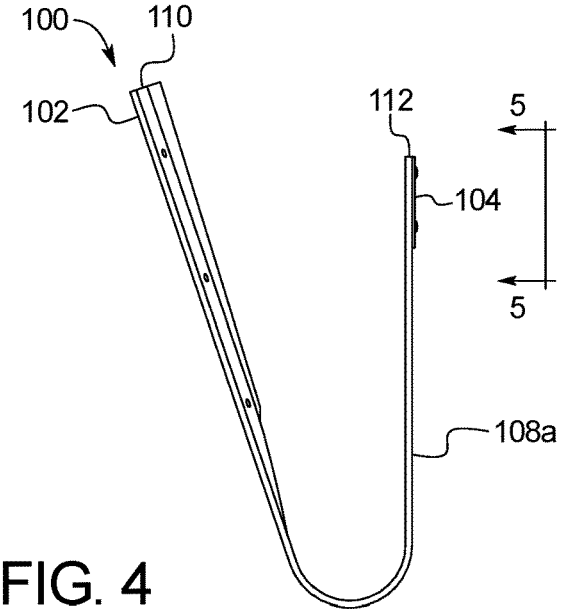
FIG. 4 is a side elevational view of the rebounding device of FIG. 1.

Best seen in FIGS. 2A and 2B, the front end 110*a*, 110*b* of each front planar surface 114*a*, 114*b* is twisted relative to a juncture 120 at which the front planar surface 114 meets the rounded portion 118. An inner edge 122 of the front end 110 is offset relative to an inner edge 124 at the juncture 120, while the outer edge 126 of the front end 110 and the outer edge 128 of the juncture 120 are aligned, best seen in FIG. 2B. Each inner edge of each front planar surface is twisted inwardly toward the respective rear planar surface to form a cradle for receiving the back of the user as shown in FIG. 6B. Further, as seen most clearly in FIGS. 5, 7E, and 7G, a rear end of the rear planar surface of the second spring element is offset from the front end of the front planar surface of the second spring element. In other words, the rear planar surfaces 116 are angled slightly inwardly towards one another as they extend outwardly from the rounded portion 120.

The first and second spring elements 108 may be comprised of any material that provides sufficient elasticity to enable repeated rebounding motions while being sufficiently strong to structurally support a person's weight. Example metallic materials include aluminum, an aluminum alloy preferably but not necessarily having a T6 temper, such as 6061T6, steel, and a steel alloy such as AISI 5160. The device may also be made of plastic such as polyvinyl chloride, a carbon fiber composite material, or a wood material.

As shown in FIGS. 1 and 6B, the front member 102 has a concave curvature between the first and second front planar surfaces 114*a*, 114*b*. In one embodiment, the front member 102 is a metallic plate, such as aluminum. Pressure applied to the front member 102 causes the front planar portions 114 to move toward the respective rear planar portions 116.

Figure 5:
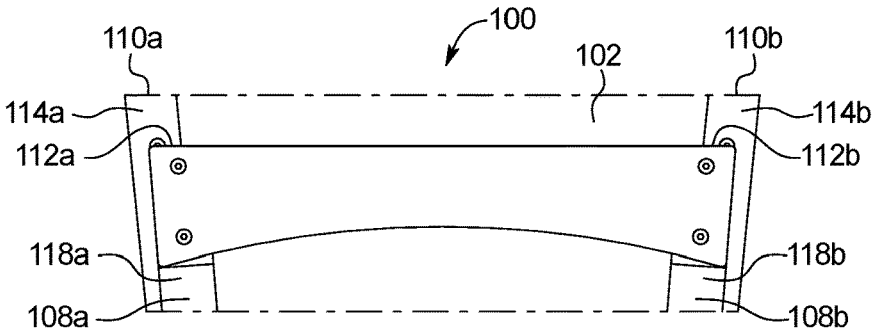
FIG. 5 is an elevational view of a rear member of the rebounding device of FIG. 1.
Figure 6A:
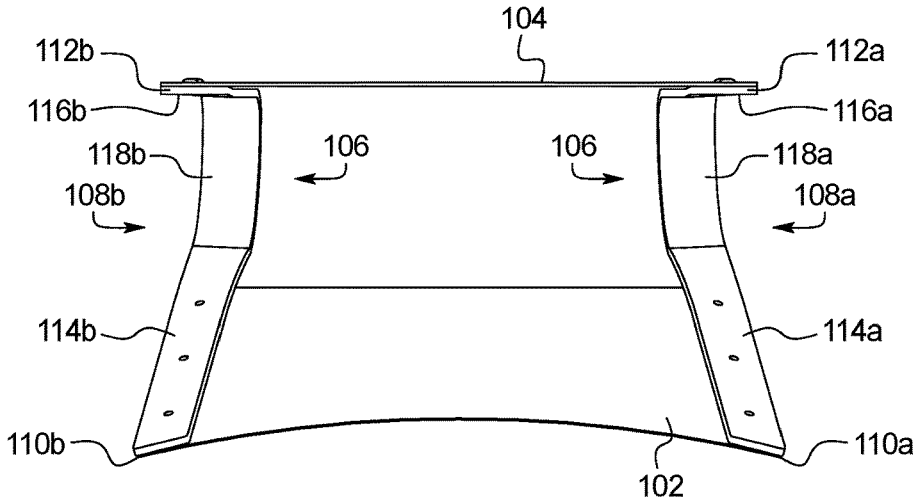
FIGS. 6A and 6B are top views of the rebounding device of FIG. 1 taken normal to the front member and the rear member, respectively.
Figure 6B:
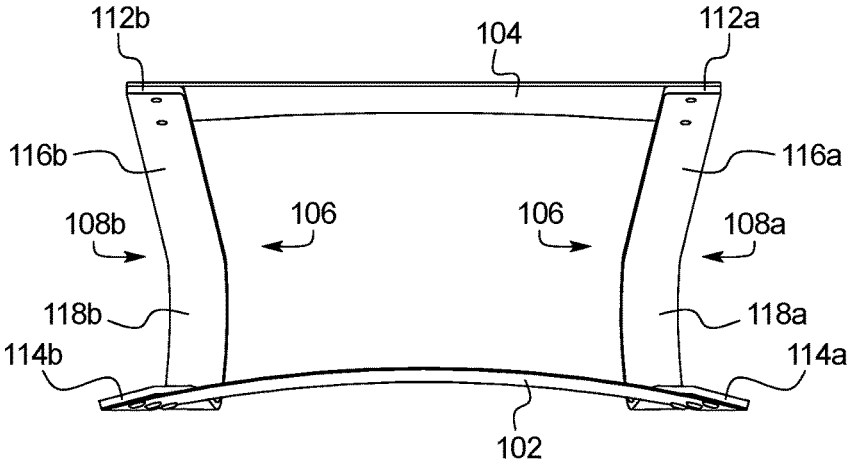

Referring to FIG. 5, the rear member 104 extends between the first and second rear planar surfaces 116*a*, 116*b* adjacent to the respective rear ends 112*a*, 112*b*. The rear member 104 comprises a metallic material, such as aluminum. Shown in FIG. 6A, the rear planar surfaces 116 of each spring member 108 are flat and co-planar relative to each other in order to apply an equal distribution of pressure onto the stationary surface. During use, the user's back rests comfortably against the front member 102 and angled front planar surfaces 114 while the rear planar surfaces 116 rest against the stationary surface.

In one embodiment, each elongate spring element 108 may have a width W that ranges between about 1.5 in. and about 2.5 in., although the width may vary as desired and may vary throughout the length L. Each spring element 108 may also have a thickness T that ranges between about 0.125 in. and about 0.25 in., created by a single layer or multiple, stacked layers. In the illustrated embodiment, the width W and thickness T of the spring elements 108 vary along the length L, having smaller values at the rounded portions 118 than at the front and rear ends 110, 112. In other embodiments, the width W and thicknesses T of the spring elements 108 vary based on manufacturing processes and/or as desired.

In the embodiment illustrated in FIGS. 1-6B, the rebounding device 100 has the dimensions recited in the following table in reference to FIGS. 7A-7J. It is understood that the dimensions are exemplary only and do not limit the scope of any claims herein, except as may be recited thereby, together with equivalents thereof. The dimensions may vary depending during the manufacturing process or as otherwise desired.

TABLE 1

Figure 7A:
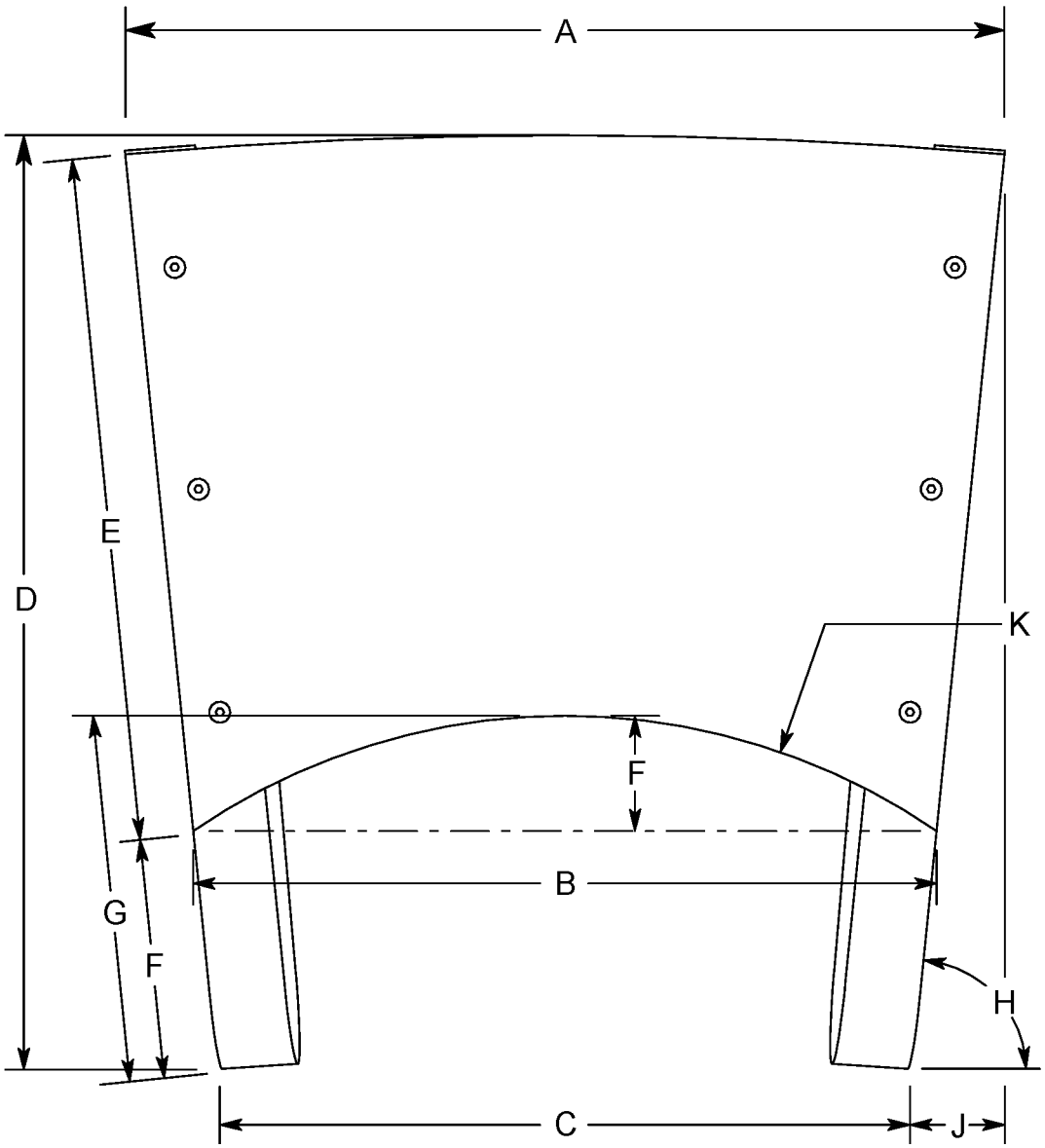
FIGS. 7A-7D are front, side, rear, and top views of the rebounding device of FIG. 1, illustrating dimensions.
Figure 7B:
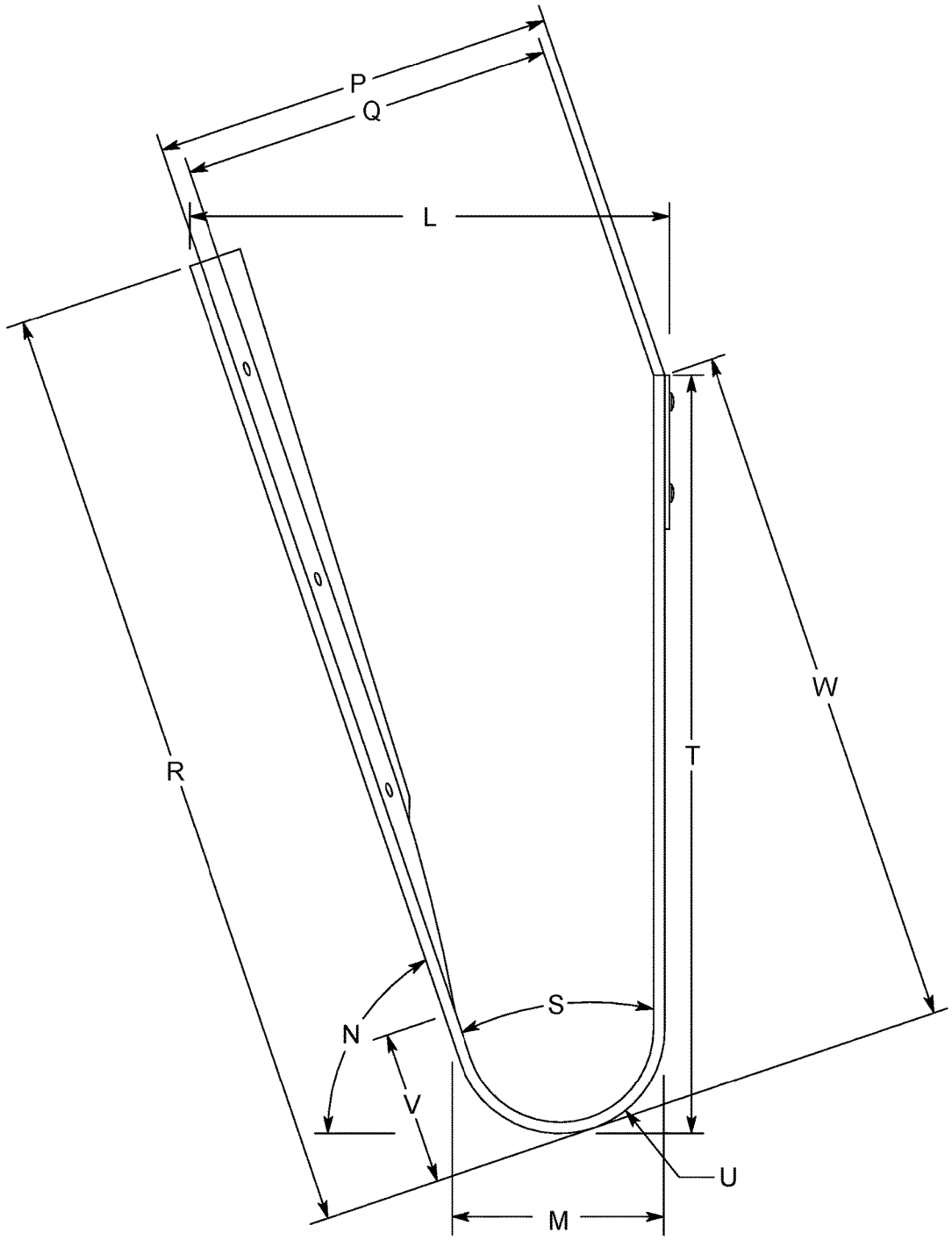
Figure 7C:
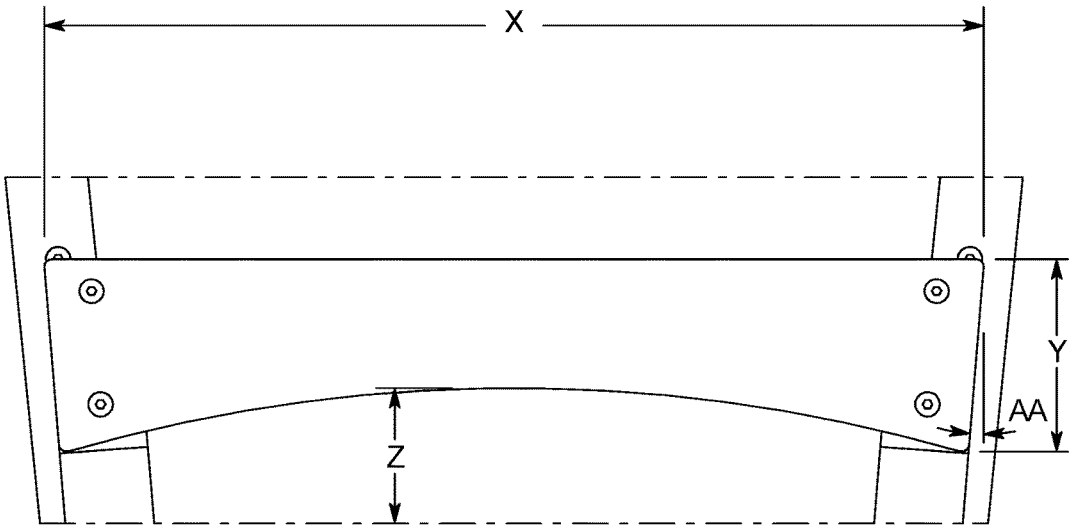
Figure 7D:
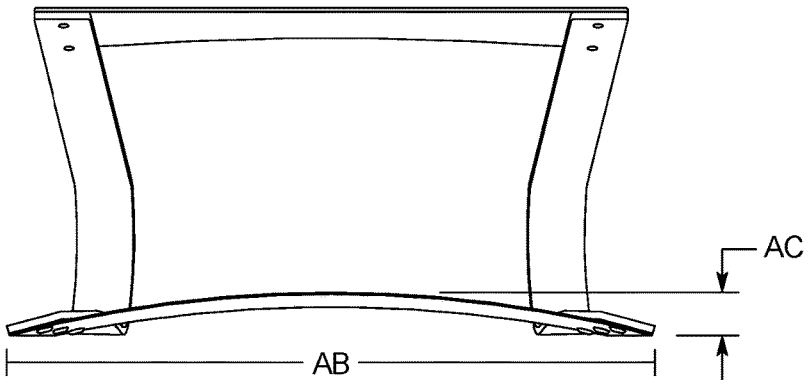
Figure 7F:
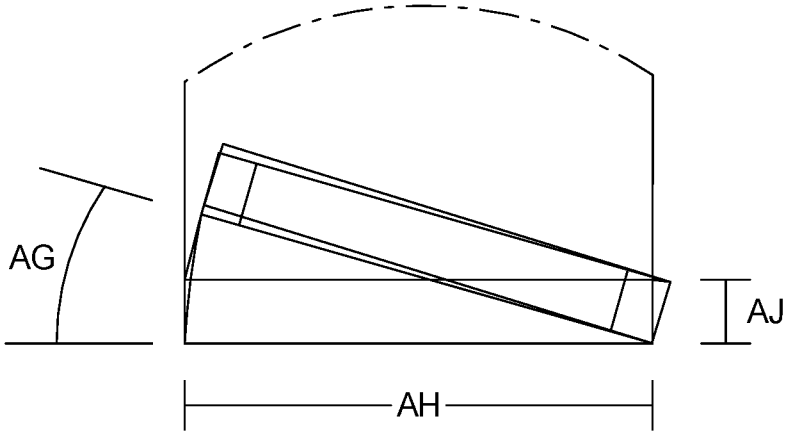
FIGS. 7F and 7H are top plan views of the front planar surfaces of the first and second spring elements, respectively, of the rebounding device of FIG. 1, illustrating dimensions.
Figure 7E:
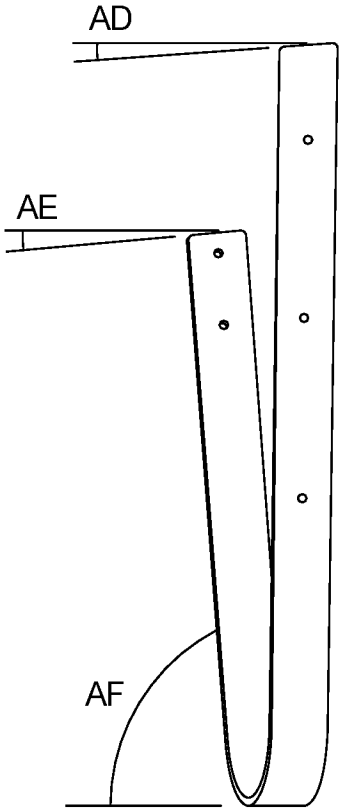
FIGS. 7E and 7G are front views of the first and second spring elements, respectively, of the rebounding device of FIG. 1, illustrating dimensions.
Figure 7H:
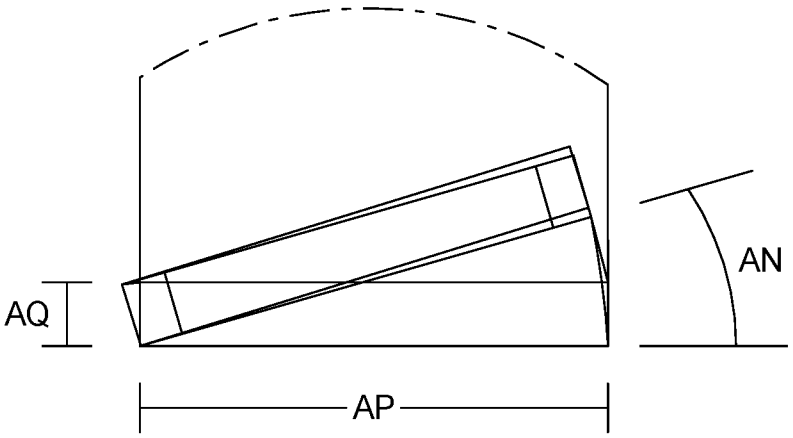
Figure 7G:
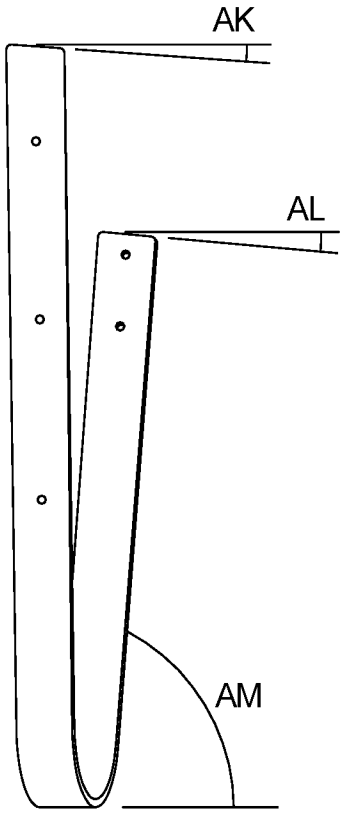

| | Dimensions (in. unless otherwise specified) |
|---|---|
| FIG. 7A | |
| A | 15.75 |
| B | 13.4 |
| C | 12.5 |
| D | 16.93 |
| E | 12.99 |
| F | 5.19 |
| G | 6.63 |
| H | 85 degrees |
| J | 5 degrees |
| K | 12.32 (radius of curvature) |
| FIG. 7B | |
| L | 9 |
| M | 4 |
| N | 72 degrees |
| P | 8 |
| Q | 7.13 |
| R | 18.06 |
| S | 18 degrees |
| T | 13.60 |
| U | 4 (radius of curvature) |
| V | 2.39 |
| W | 13.59 |
| FIG. 7C | |
| X | 14.5 |
| Y | 2.96 |
| Z | 0.96 |
| AA | 4 degrees |
| FIG. 7D | |
| AB | 15.75 |
| AC | 1.00 |
| FIG. 7F | |
| AD | 5 degrees |
| AE | 5 degrees |
| AF | 85.66 |
| FIG. 7G | |
| AG | 16 degrees |
| AH | 1.38 |
| AJ | 0.19 |
| FIG. 7H | |
| AK | 5 degrees |
| AL | 5 degrees |
| AM | 85.66 degrees |

TABLE 1-continued

| | Dimensions (in. unless otherwise specified) |
|---|---|
| FIG. 7J | |
| AN | 16 degrees |
| AP | 1.38 |
| AQ | 0.19 |

Figure 16:
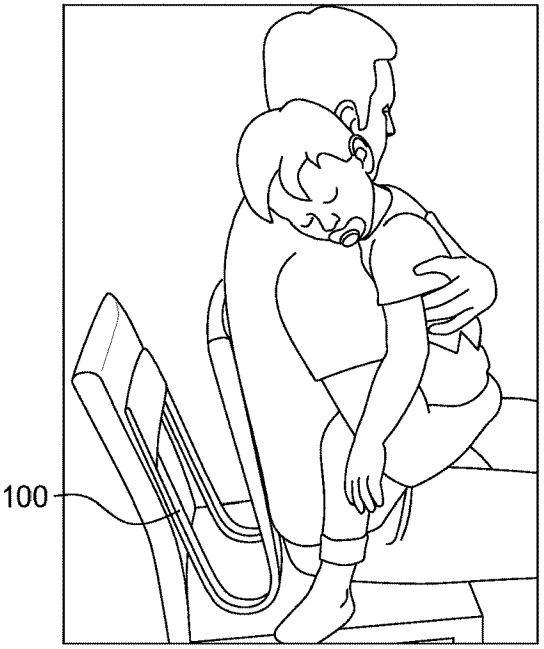
FIGS. 16-18 illustrate the rebounding device in the decompressed, the partially compressed, and the compressed positions, respectively.
Figure 17:
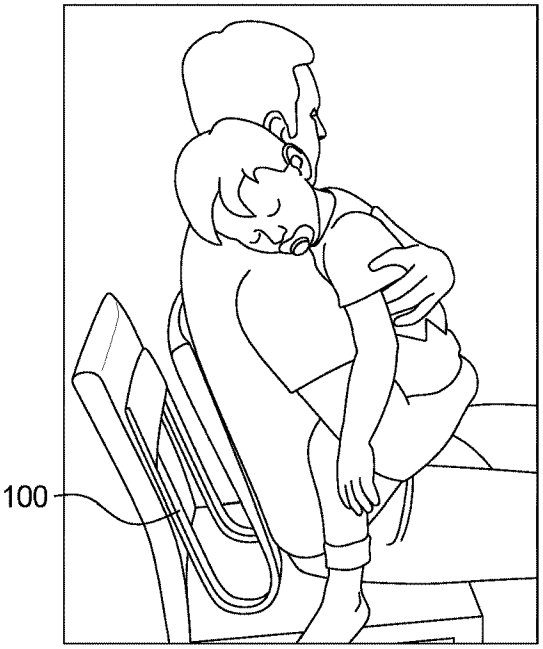
Figure 18:
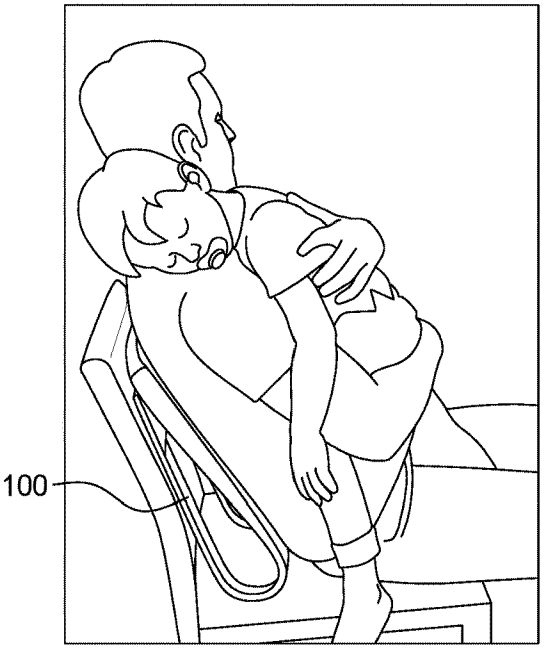
Figure 19:
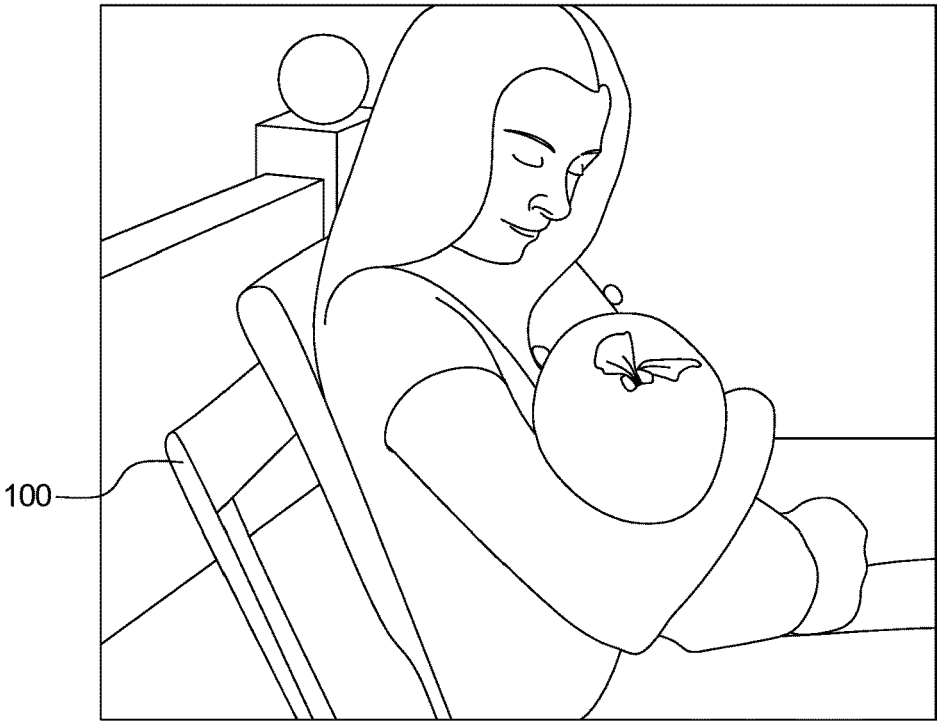
FIGS. 19-21 illustrate various environments in which the rebounding device may be used.
Figure 20:
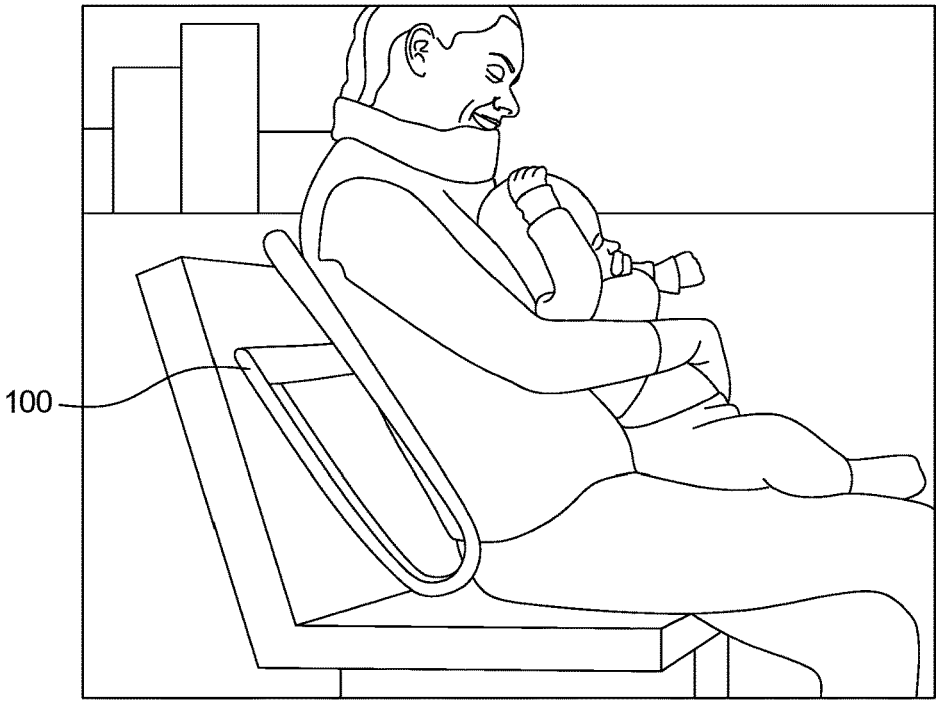
Figure 21:
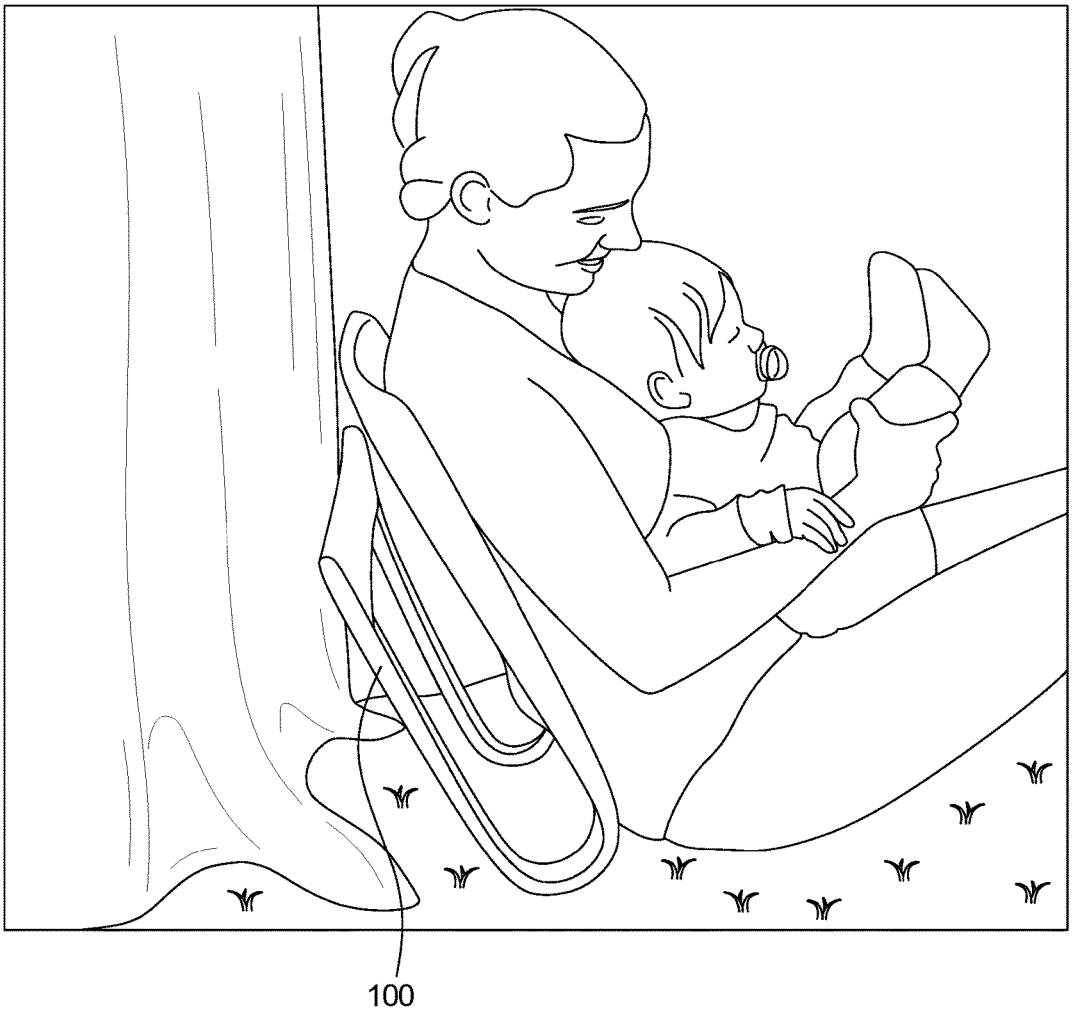

During use, the user positions the rear surface 104 of the device 100 against a stationary object such as a chair or a wall as shown in FIGS. 16-18. The user rests his back against the front member 102, and applies pressure to generate a gentle rocking motion to move the rebounding device 100 between a least compressed position and a most compressed position. In FIG. 16, the rebounding device 100 is in the least compressed position, with the front member 102 farthest from the rear member 104. FIG. 17 illustrates the rebounding device 100 in a partially compressed position, with the front member 102 mid-way to the rear member 104. FIG. 18 shows the rebounding device 100 in the most compressed position, with the front member 102 closest to the rear member 104. The spring mechanism 106 exerts a biasing force when compressed that propels the user's upper body forward while maintaining a seated position. FIGS. 19-21 show the rebounding device 100 used in a variety of environments, such as on a bed, on a park bench, and against a tree, in addition to the use on a chair as shown in FIGS. 16-18.

Figure 8A:
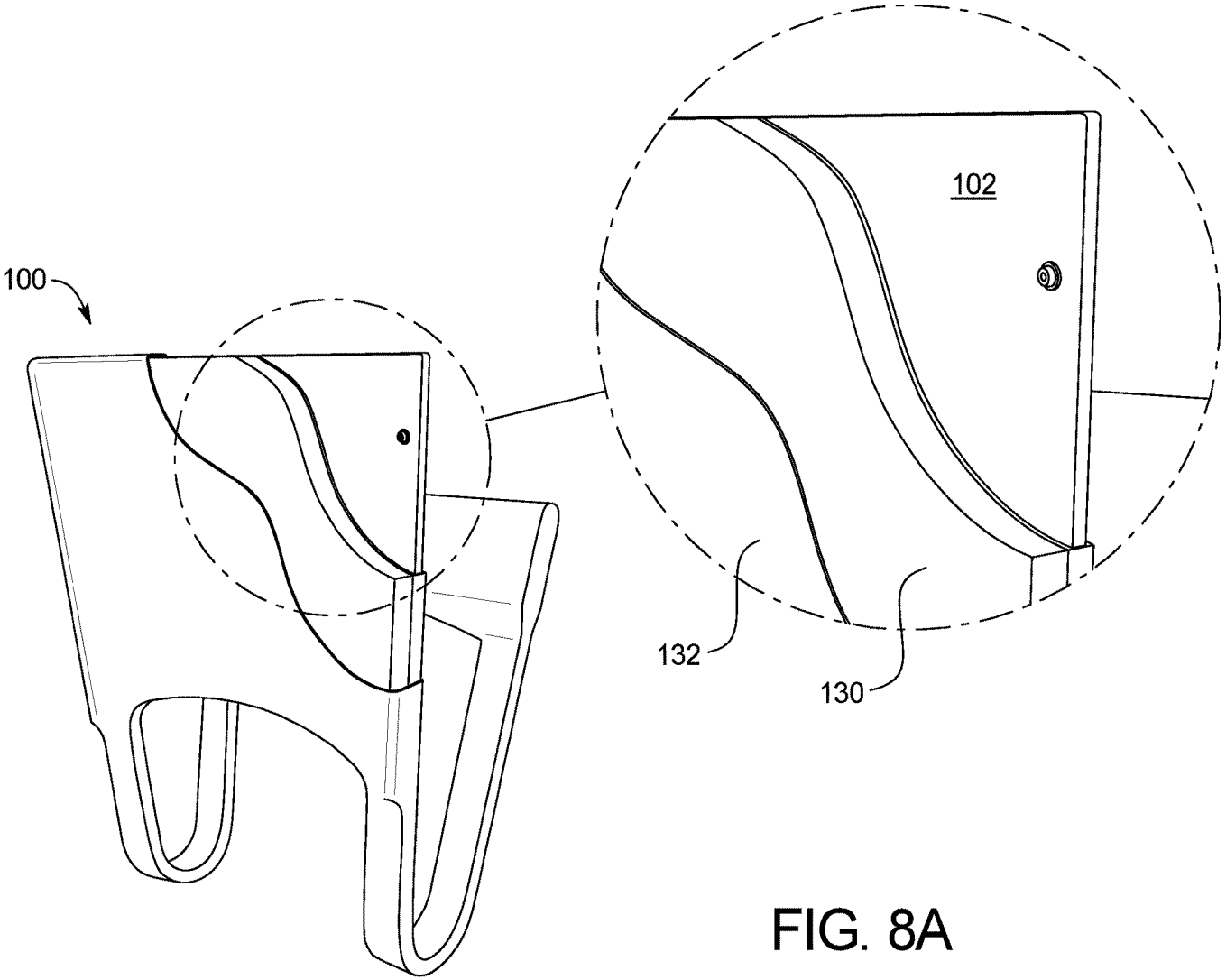
FIG. 8A is a cutaway view of a front member alternative embodiments of the rebounding device of FIG. 1.

Referring to FIG. 8A, a foam pad 130, a rubber material such natural latex, or other thick, cushioning material may be secured to the front member 102 or the flexible material and may optionally be encapsulated within a separate housing material 132. The housing material may extend around the entire rebounding device 100, may be limited to surrounding the front member 102 and the front planar surfaces 114 of the spring elements 108 as well as the rear member 104 and the rear planar surfaces 116 of the spring elements 108, or another other select portion of the rebounding device 100. The housing material may be a plastic such as a polyvinyl chloride, a carbon fiber composite material, a leather material, or any other suitable material. In some embodiments, the housing may also include a plurality of layers, including one or more of the following: a cushioning material, a rubber material, a para-aramid synthetic fiber material such as Kevlar, and a fabric or leather outer layer. In a still further embodiment, each of the front and rear members 102, 104 may comprise a fabric material that includes tubular portions for receiving front and rear planar portions of the spring elements. The dimensions of the fabric front and rear members is sufficiently taut so as to support the user's weight and a bouncing force.

Figure 8B:
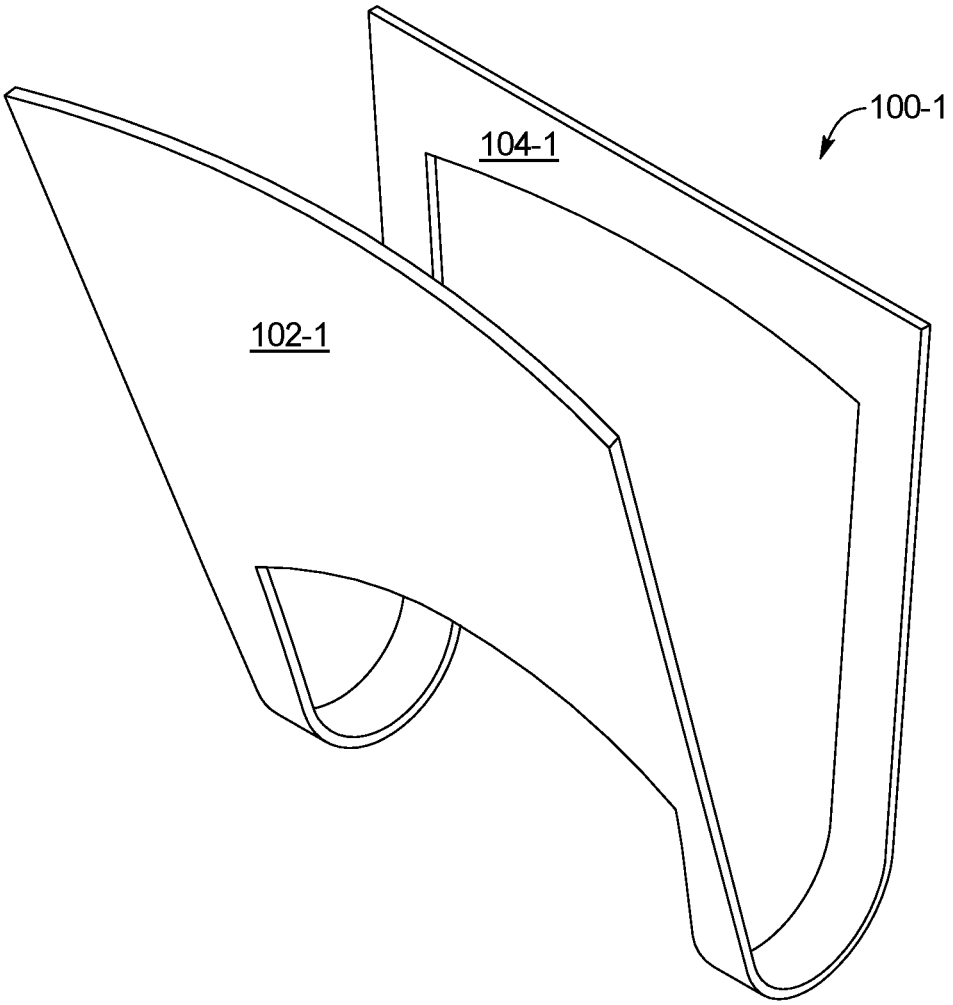
FIG. 8B is a further embodiment of the rebounding device of FIG. 1.

In a further embodiment illustrated in FIG. 8B, the components of the rebounding device 100 may be formed integrally. The rebounding device 100-1 including a front member 102-1, a rear member 104-1, and a spring mechanism 106-1 positioned between the front and rear members 102-1, 104-1. In one embodiment, the rebounding device 100-1 may be comprised of a metal such as an aluminum alloy, that is stamped, laser cut, water-jetted, or otherwise cut from a sheet of the material and pressed into formation. In other embodiments, the rebounding device 100-1 may comprise a wooden material shaped into formation. In still further embodiments, the rebounding device 100-1 may be a polyvinyl chloride material that is that is molded, such as injection molded, into formation. The material and method of manufacture may vary based on the manufacturing process or as desired.

Figure 8C:
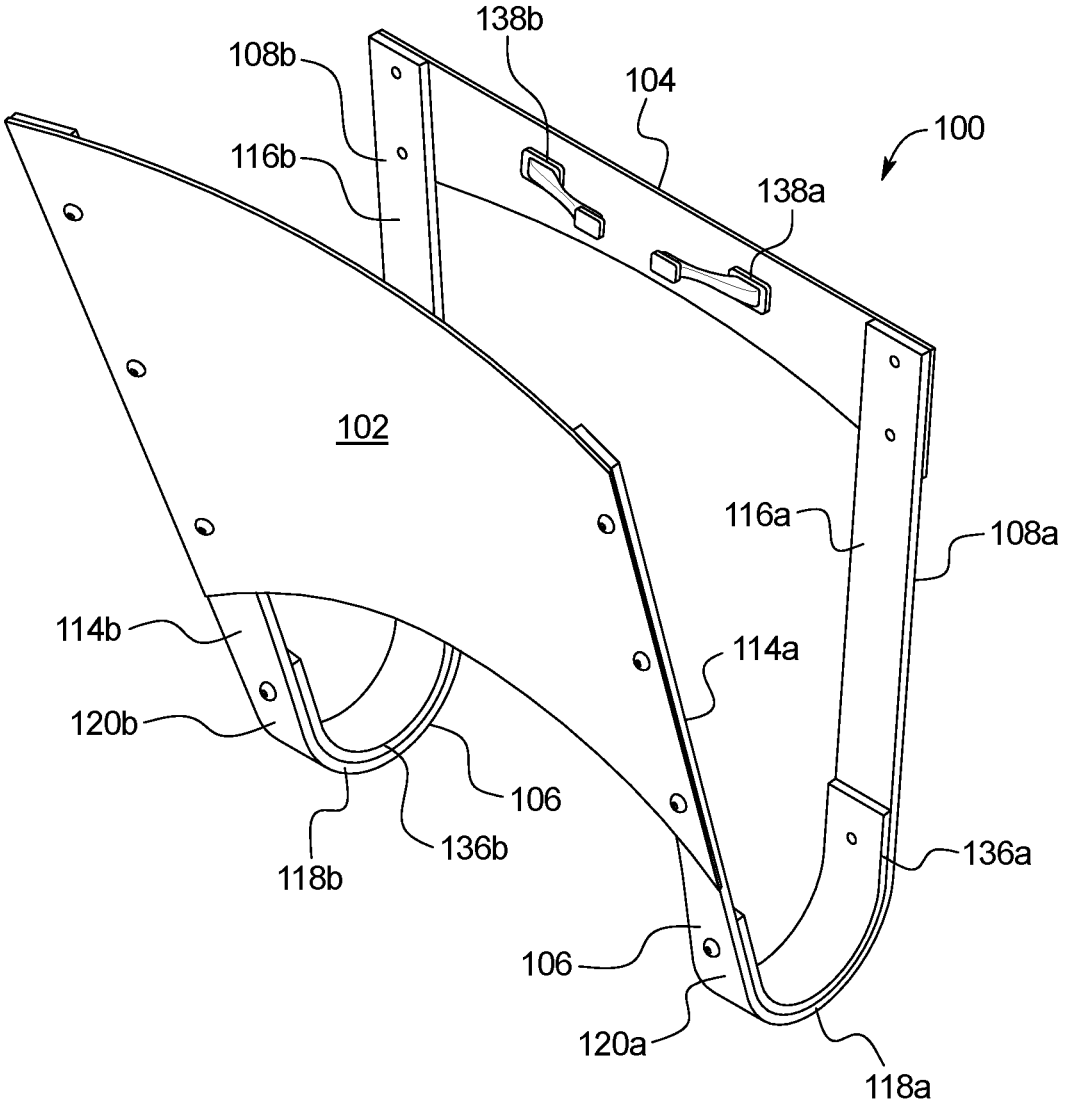
FIG. 8C is a perspective view of the rebounding device of FIG. 1, including optional reinforcing spring elements.
Figure 9:
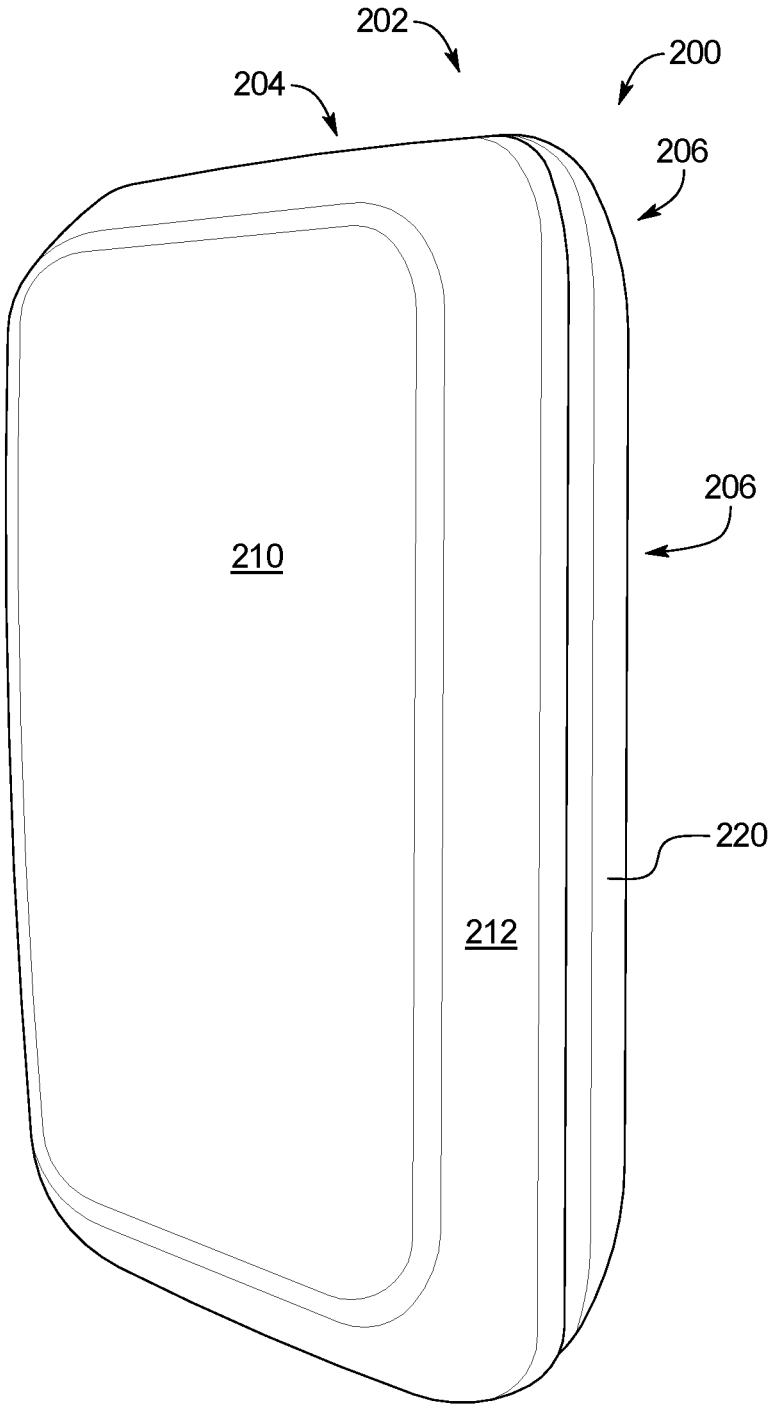
FIG. 9 is a perspective view of an alternative embodiment of a rebounding device of the present application.
Figure 14:
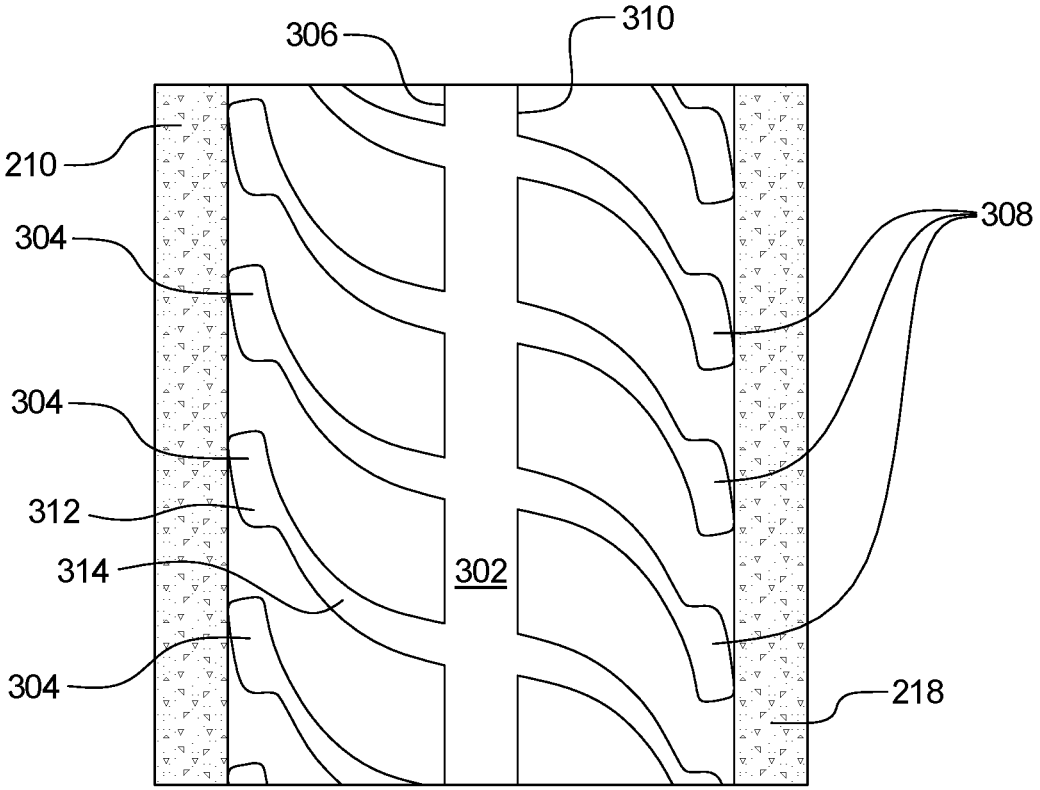
FIGS. 14 and 15 are example springing mechanisms used in the rebounding device of FIG. 8.
Figure 15:
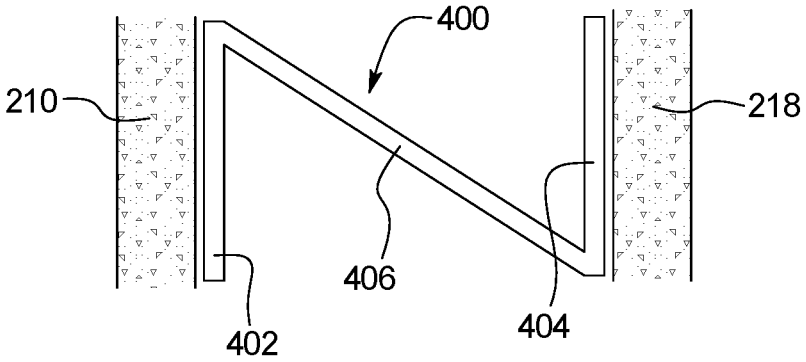

Further, the spring elements 108 may be modified to include one or more reinforcing spring elements that provide additional elasticity and/or strength to account for heavier users. The number, position, and location of reinforcing elements may vary as desired or, in some embodiments, based on the user's preference. In the embodiment illustrated in FIG. 8C, a reinforcing spring element 136 is secured to the rounded portion 120 of each of the first and second spring elements 108*a*, 108*b*. Each reinforcing spring element 136 has a length that extends along the rounded portion 120 of the spring element 108. In one embodiment, the reinforcing spring elements 136*a*, 136*b* are welded or otherwise secured to the respective rounded portion 120*a*, 120*b*. In other embodiments, the reinforcing spring elements 136*a*, 136*b* may be snapped into place or otherwise added only if desired. In still further embodiments, the reinforcing element 136 comprises a torsion spring that may be adjusted. In still further embodiments, the reinforcing spring element 136 may include one or more torsion springs, one or more leaf springs or a Z-shaped spring as illustrated in FIGS. 14 and 15, respectively, that is secured to the inner surfaces of the rear member between the spring elements 108*a*, 108*b*. In this embodiment, leaf springs 138*a*, 138*b* may be secured to the inner surface of the rear member 104 and provide resistance against the front member 102 only when a significant amount of pressure is applied by a user to the front member 102 during use. In other embodiments, one or more reinforcing spring elements are added to one or more of the following locations: inside or outside of the rounded portion 120, between the front and rear planar surfaces, 114, 116 of each spring element 108, and between the front and rear members 102, 104. The use of reinforcing spring element(s) 136, 138 enables the rebounding device 100 to be used by a heavier person and to increase the life of the spring elements 108. The ability to optionally add and/or adjust reinforcing spring elements also enables the rebounding device to be purchased for a single home and used for people of various sizes.

In still further embodiments, the rebounding device 100 may include first and second rubber guards that extend along the rounded portions 120 of the spring members 108. The rubber guards may include treaded portions that prevent the rebounding device 100 from slipping on the floor, the seat of a chair, or other surface during use.

The rebounding device 100 may also include first and second structural members that, when in use, support the rebounding device to be used on its own without being positioned against a structural support such as the back of a chair or a wall. In one embodiment, the first and second structural members are hingedly attached to the rear planar portions 116*a*, 116*b* of the first and second spring members 108*a*, 108*b*, respectively, so that they rotate between an open position and a closed position. In the closed position, the structural members are secured to the rear planar portions 116, allowing the rebounding device 100 to be used against a structural surface such as a chair, a wall, or the like, as described above. When the structural members are in the open position, they extend away from the rear planar portions 116 so that the rear planar portions 116 form an acute angle with the surface on which the rebounding device 100 is positioned. The user can then lean against the rebounding device 100, creating the rocking motion without the need for a piece of furniture or other structural support.

The dimensions of the rebounding device 100 may be modified in order to tailor the device to a specific use. For example, the width of the first and second spring elements 108 of the rebounding device 100 may be wider than illustrated herein in order to accommodate for usage with a wheelchair or a hospital bed.

Referring to FIGS. 9-13, a further embodiment of a rebounding device 200 is provided. The rebounding device 200 includes a housing 202 having adjacent front and rear members 204, 206 that contains a spring mechanism 208. The housing 202 is made of an easily compressible material. During use, the user positions the rebounding device 200 between his back, preferably anywhere along the thoracic and lumbar regions of the back, and a supporting surface such as a wall.

Figure 12:
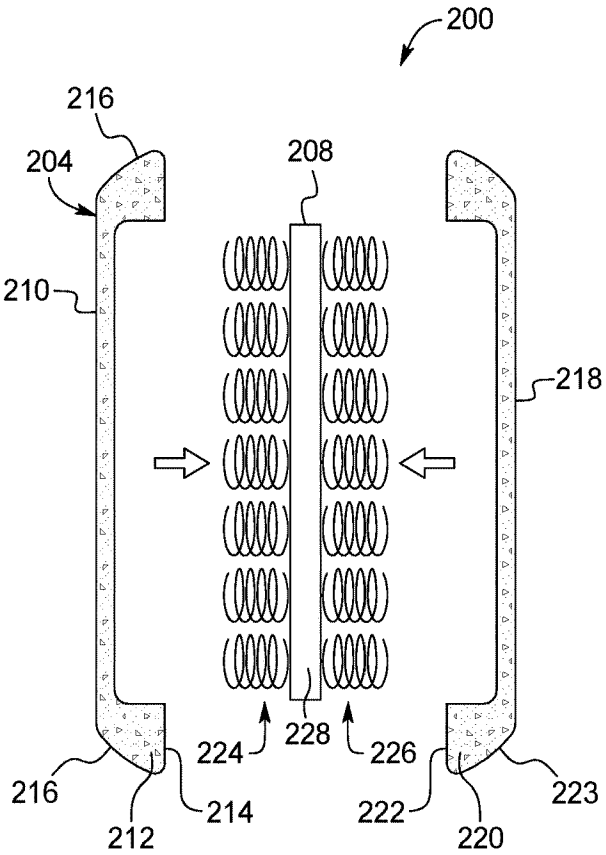
FIG. 12 is an exploded, cross-sectional side elevational view of the rebounding device of FIG. 9, taken generally along lines 12-12 of FIG. 10.
Figure 11:
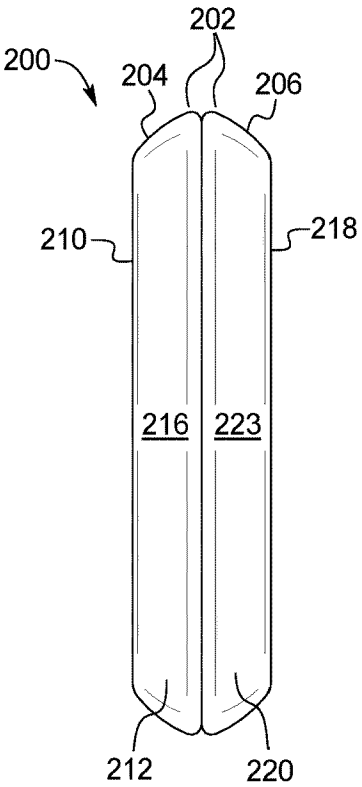
FIG. 11 is a side elevational view of the rebounding device of FIG. 9.
Figure 10:
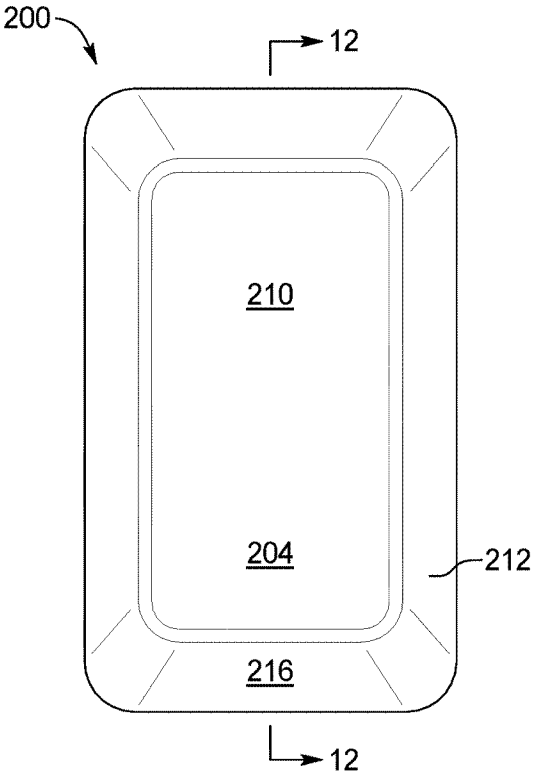
FIG. 10 is a front elevational view of the rebounding device of FIG. 9.
Figure 13:
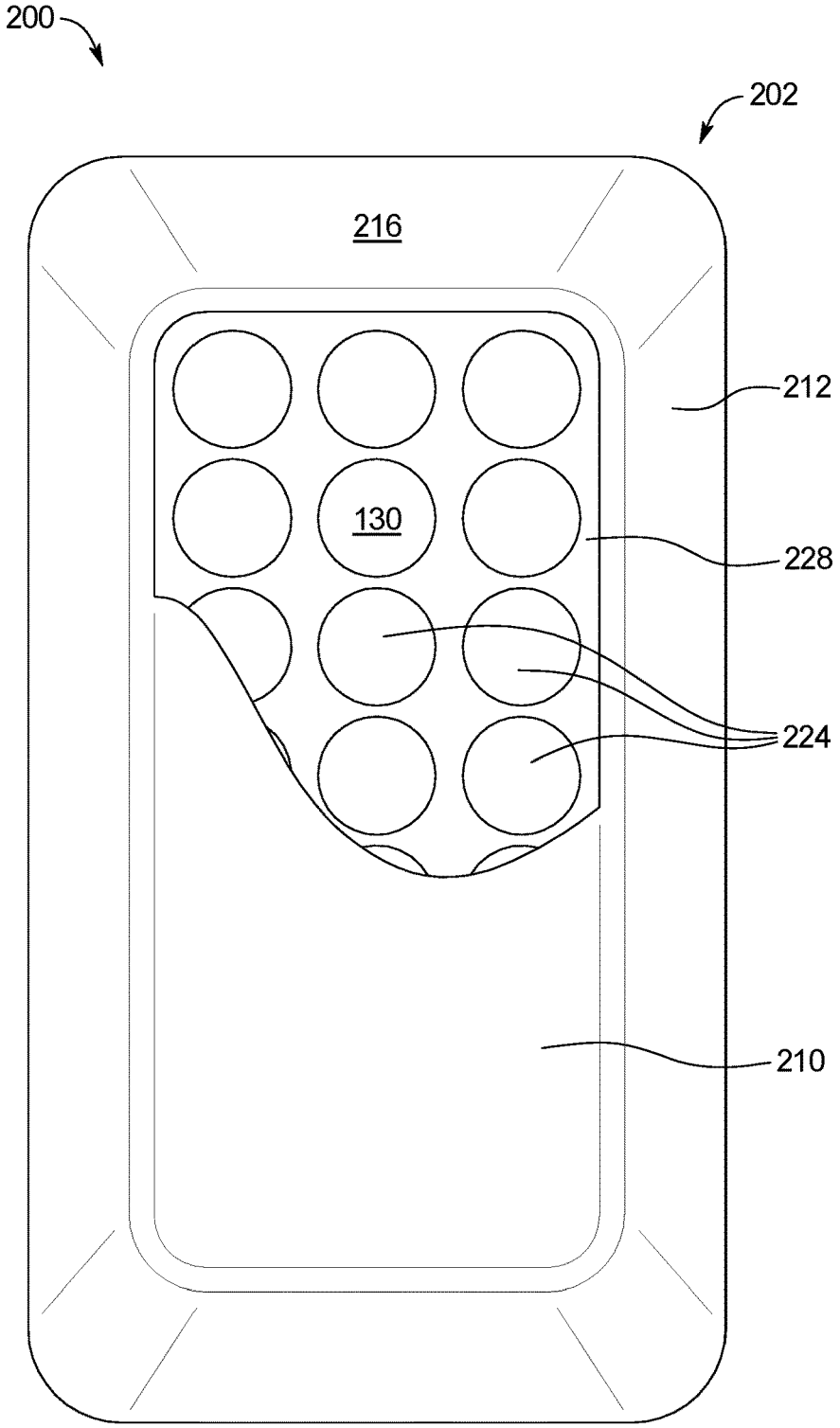
FIG. 13 is a front elevational view of the rebounding device of FIG. 9, with a portion of the front member cut away.

Seen best in FIG. 12, the front member 204 of the housing 202 includes a planar front surface 210 surrounded by a front wall 212. A thickness of the front wall 212 is wide at a front base 214 and is narrow adjacent to the planar surface 210, forming a sloped outer surface 216. Similarly, the rear member 206 includes a planar rear surface 218 surrounded by a rear wall 220 having a greater thickness at a rear base 222 than near the planar rear surface, forming a sloped outer surface 223, 218. Each of the front and rear wall may include material having an accordion-like shape that allows for each compression. While both of the planar surfaces 210, 218 and the surrounding walls 212, 220 are comprised of a compressible material, the density of the planar surfaces 210, 218 is greater than the density of the surrounding walls 212, 220. During use, the front and rear bases 214, 222 of the front and rear members 204, 206 are adjoined together by a bonding means such as fusion, a solvent, welding, or any suitable process for bonding.

In some embodiments, the housing 202 may be comprised of a compressible material such as a foam or a rubber such as natural latex, which also allows for breathability and minimizes the weight of the device. Other materials that may be used include soft plastics or a polyester material. The rebounding device 200 may also include a cover or casing (not shown) that surrounds the housing 202. The cover may be a washable, upholstery material with or without a textured surface. Heating or cooling elements may be incorporated into the housing 202 and/or the cover.

The spring mechanism 208 is positioned between the front and rear members 204, 206. In the embodiment illustrated in FIGS. 12 and 13, the spring mechanism 208 comprises a first plurality 224 of helical spring elements and a second plurality 226 of helical spring elements secured to a base surface 228. The pluralities 224, 226 of helical spring elements bias against the planar front and rear surfaces 210, 218. The distributed structuring of the springs 224, 226 provides an even spring sensation for the user.

Any suitable spring mechanism 208 having any type, form, or shape of a spring may be used, such as a leaf spring mechanism 300 as shown in FIG. 15. The leaf spring mechanism 300 includes a central core 302 having a first plurality of leaf spring elements 304 extending from a first side 306 and a second plurality of leaf spring elements 308 extending from a second side 310. Each leaf spring 304, 306 includes a planar end 312 attached to a body 314 extending from the respective surface 306, 310 at an angle. The planar end 312 of each leaf spring element 204, 208 contacts the front or rear planar surface 210, 218 of the front and rear members 204, 206, respectively, during use.

An alternative spring may include a Z-shape spring 400 as shown in FIG. 15. The parallel sides 402, 404 of the spring 400 contact the front or rear planar surface 210, 218 of the front and rear members 204, 206, respectively, during use. A base member 406 extending at an angle between the parallel sides 402, 404 compresses to create the rebounding motion.

As described above, the rebounding device 100, 200 can be used in a variety of applications, from rocking an infant to sleep to the comfort and benefit for those with conditions such as dementia, anxiety, and autism. It should be noted that various changes and modifications to the presently preferred embodiments described herein will be apparent to those skilled in the art. Such changes and modifications may be made without departing from the spirit and scope of the present invention and without diminishing its attendant advantages.

The invention claimed is:

1. A rebounding device comprising:

a front member;

a rear member; and a spring mechanism positioned between the front member and the rear member for allowing the front member and rear member to move toward and away from one another.

2. The rebounding device of claim 1, wherein the spring mechanism comprises first and second spring elements having a length and a width, wherein the length is greater than the width, and wherein the first and second spring elements curved about an axis parallel to the width.

3. The rebounding device of claim 2, wherein each of the first and second spring elements comprises a front planar portion, a rear planar portion, and a rounded portion between the front and rear planar portions.

4. The rebounding device of claim 3, wherein a first front end of the front planar surface of the first spring element distal from the rounded portion is angled relative to the width of the spring element along the rear planar surface and rounded portion.

5. The rebounding device of claim 4, wherein a second front end of the front planar surface of the second spring element distal from the rounded portion is angled relative to the width of the spring element along the rear planar surface and rounded portion.

6. The rebounding device of claim 5, wherein a first inner edge and a second inner edge of the first front end and the second front end, respectively, angle inwardly toward the rear planar surfaces.

7. The rebounding device of claim 6, wherein the front member comprises a curved surface.

8. The rebounding device of claim 7, wherein the curved surface of the front member corresponds to the inward angled first and second front ends of the first and second front planar portion of the spring elements.

9. The rebounding device of claim 3, wherein the front member comprises a curved surface.

10. The rebounding device of claim 3, wherein a rear end of the rear planar surface of the first spring element is offset from the front end of the front planar surface of the first spring element.

11. The rebounding device of claim 10, wherein a rear end of the rear planar surface of the second spring element is offset from the front end of the front planar surface of the second spring element.

12. The rebounding device of claim 1, wherein the front member, the rear member, and the spring mechanism are integrally formed.

13. The rebounding device of claim 1, wherein the front member includes a planar front surface surrounded by a front wall, the front wall having a front base distal to the planar front surface, and wherein the rear member includes a planar rear surface surrounded by a rear wall, the rear wall having a rear base distal proximal to the planar rear surface.

14. The rebounding device of claim 13, wherein the front member and the rear member include a front outer sloped surface and a rear outer sloped surface, respectively, adjacent to the front planar surface and the rear planar surface, respectively.

15. The rebounding device of claim 13, wherein the spring mechanism comprises one selection from the group of a plurality of helical springs, a plurality of leaf springs, and at least one Z-shaped spring.

16. The rebounding device of claim 15, wherein the front base and the rear base are adjoined.

17. The rebounding device of claim 13, wherein the first member and the second member comprise a compressible material.

18. The rebounding device of claim 17, wherein the compressible material is a breathable foam.

* * * * *